US006168125B1

(12) United States Patent
Winger et al.

(10) Patent No.: US 6,168,125 B1
(45) Date of Patent: Jan. 2, 2001

(54) ADJUSTABLE RAILING BRACKET

(75) Inventors: Timothy M. Winger, Lancaster; Michael Salamh, Pequea; Darren C. Epstein, Strasburg; Robert A. Frey, Conestoga, all of PA (US)

(73) Assignee: Novelty Manufacturing Co., Lancaster, PA (US)

( * ) Notice: Under 35 U.S.C. 154(b), the term of this patent shall be extended for 0 days.

(21) Appl. No.: 09/201,009

(22) Filed: Nov. 30, 1998

(51) Int. Cl.[7] ..... E04D 13/072

(52) U.S. Cl. ..... 248/228.3; 52/11; 248/48.2; 248/48.1

(58) Field of Search ..... 248/231.41, 295.11, 248/298.11, 297.21; 52/11

(56) References Cited

U.S. PATENT DOCUMENTS

| | | | | |
|---|---|---|---|---|
| 1,017,174 | * | 2/1912 | Sander et al. | 248/48.2 |
| 1,755,453 | * | 4/1930 | Mullen | 248/48.2 |
| 3,544,049 | * | 12/1970 | Brown et al. | 248/316.2 |
| 3,957,240 | | 5/1976 | Johansson | 248/214 |
| 5,007,240 | | 4/1991 | Manfre | 248/558 |
| 5,106,046 | * | 4/1992 | Rowles | 248/214 |
| 5,240,214 | | 8/1993 | Birnbaum et al. | 248/231.4 |
| 5,320,319 | | 6/1994 | Winger et al. | 248/312.1 |
| 5,779,206 | * | 7/1998 | Harris et al. | 248/214 |
| 5,884,876 | * | 3/1999 | Axford | 248/48.2 |

* cited by examiner

*Primary Examiner*—Anita M. King
*Assistant Examiner*—Kimberly Wood
(74) *Attorney, Agent, or Firm*—Martin Fruitman

(57) ABSTRACT

The invention is an adjustable bracket for supporting items on the railings of house decks. The bracket is formed of only two parts without any fasteners. The parts interlock, but can be adjusted to form a clamp around the typical rectangular cross section rail. One part is a support unit which is a simple strap with two bends in it to form two offset sections, and the second part is a clamp unit which is a hook shaped strap with a long leg and a short leg. The preferred embodiment of the connection is a slot formed in the long leg of the clamp unit into which fits a tab protruding from one section of the support unit.

1 Claim, 7 Drawing Sheets

ADJUSTABLE RAILING BRACKET

BACKGROUND OF THE INVENTION

This invention deals generally with support brackets and more specifically with an adjustable bracket for hanging containers on railings of house decks.

Outdoor decks are common architectural features in present residential construction, and almost every person who owns a home with such a deck wants to place decorative or utilitarian items on the railings of such decks. The most common items hung on the railings are probably flower pots and plant containers. However, virtually all the available mounting devices for such items require attachment to the wood railings or the poles supporting the rails with wood screws. Not only are some homeowners hesitant to drill holes in their deck rails for attaching such mounting devices, but the installation process is more complicated than many people want to deal with. Even those mounting devices which do not require drilling holes into the deck rails or supports are usually either dimensioned for use on a specific size rail, or have a complex system for adjusting the size of a clamp to the size of the rail, with the adjustment feature including loose screws and nuts. It is not an exaggeration to say that while assembling a multiple part clamp held together with loose fasteners, the typical user is bound to drop some of the parts, and usually to lose them underneath the deck.

It would be very beneficial to have available an adjustable bracket for hanging containers on deck railings, with the bracket not requiring any auxiliary hardware to be lost or misplaced.

SUMMARY OF THE INVENTION

The present invention is an adjustable bracket for hanging containers on the railing of house decks, and the bracket is formed of only two units without any fasteners. The two units interlock, but can be adjusted to form a clamp around the typical rectangular cross section rail.

The bracket is constructed with the two units made of strap material, with some portions of the units having a channel configuration for added strength. The first part is a clamp unit bent into a simple hook shape with one long leg. The second part is a support unit shaped with two near right angle bends to form one upper section and one lower section offset from each other and joined by a short bridge section. The long leg of the hook on the clamp unit and the short offset section of the support unit fit together so that they rest atop the rail while the hook grips under one side of the rail and the bridge section clamps against the other side of the rail.

Several different structures can be used to form the adjustable interlocking structure. The preferred embodiment has a slot with points protruding from its sides in one of the two interlocking parts and a protruding bent finger extending from the second part and into and through the slot. The finger is itself bent sufficiently so that when it rests against a set of points, it is locked in place and prevents the parts from being moved independently. Once such a structure is assembled, the entire bracket is installed by engaging the hook on the lower edge of the rail and forcing the bridge section down over the opposite edge of the rail.

One alternate embodiment of the invention has one part with a channel configuration, and a slot is located along the web of the channel. The mating part has a slightly offset tab on one end, with the tab almost as wide as the channel width and the tab connected to the rest of the structure by a short thin neck. When the tab is turned sideways it can easily be inserted through the mating slot, but when the tabbed part is oriented parallel to the slotted part, the tab is locked between the channel section on either side of the slot and can not be removed. Serrations can also be added on the surface of the slotted part and surface of the tab which contact each other to prevent sliding once the parts are installed on a rail.

Another alternate structure uses a hole in a tab at the end of one part, with the hole sliding over and around the other part to form a collar.

Each of these structures has one feature in common. The two parts are prevented from tilting relative to each other by the interlocking structure. That feature, along with the basic shape of the assembled parts with a hook at one end and a shelf-like protrusion at the other end, permits the bracket to hook under one bottom edge of a deck rail and to support a weight below the diagonally opposite top edge.

The invention thereby supplies a rail attachment bracket which has only two parts, requires no auxiliary hardware, and, nevertheless, is adjustable to various width rails.

DETAILED DESCRIPTION OF THE INVENTION

Figure 1:
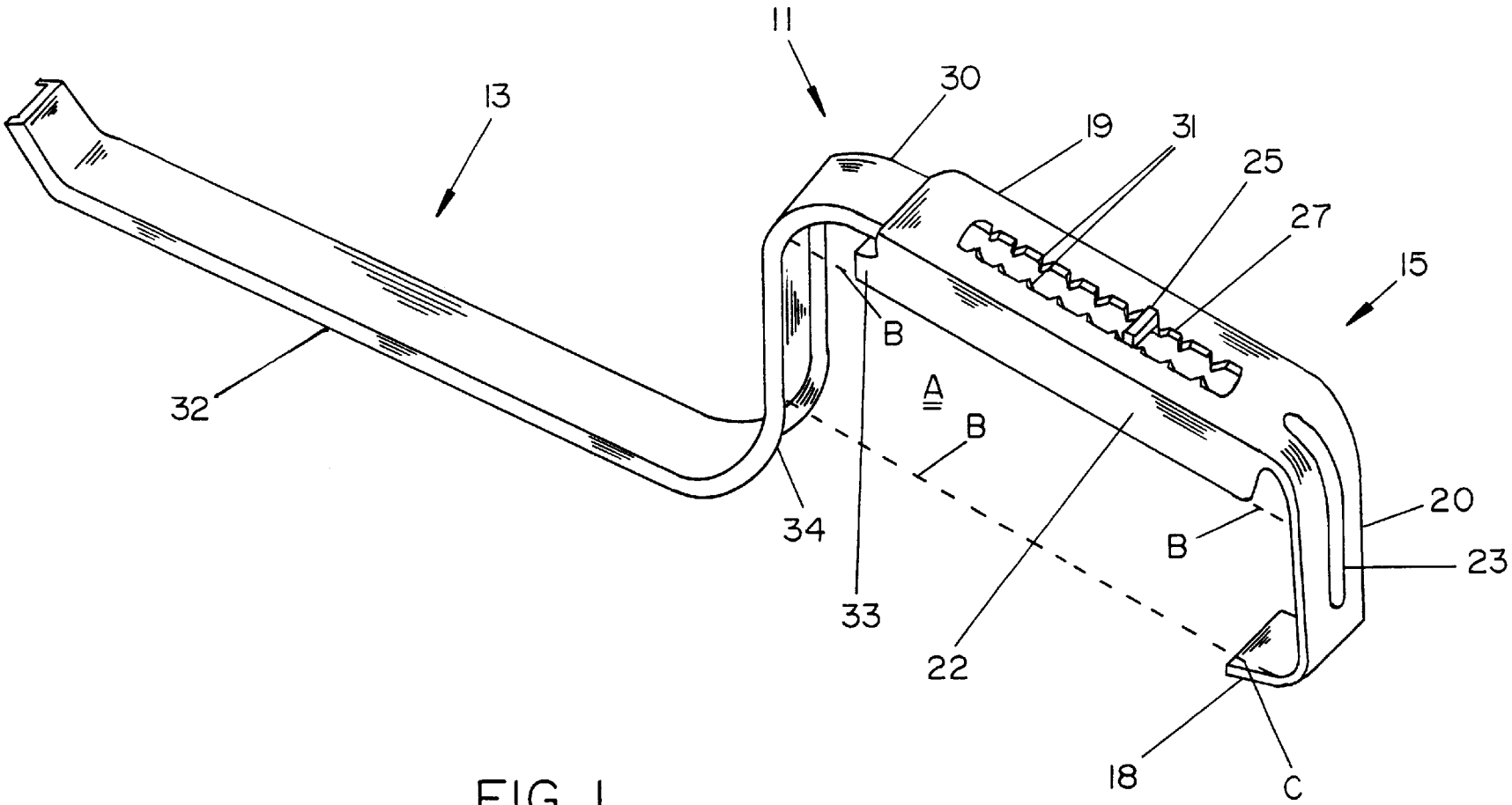
FIG. 1 is a perspective view of the preferred embodiment of the assembled bracket of the invention.

FIG. 1 is a perspective view of the preferred embodiment of the assembled bracket 11 of the invention, in which support unit 13 and clamp unit 15 interlock around rail A which is located in the space whose boundaries are indicated by dashed lines B when bracket 10 is in use.

Clamp unit 15 is built in the shape of a hook with long leg 19, short leg 18, and connecting section 20. Short leg 18 and connecting section 20 are typically constructed as simple straps, but long leg 19 may be constructed as a channel with sides 22 and groove 23 may be added to connecting section 20 to add strength to those sections.

Locking tab 25 on the end of support unit 13 (see FIG. 2) is bent in the direction away from short leg 18 and extends through slot 27, which is located in long leg 19 of clamp unit 15. Locking tab 25, as it is captured by points 31 within slot 27 thus locks support unit 13 to clamp unit 15 when the two are assembled and forced around the rail A.

Clamp unit 15 also includes pivot tab 33 at the end of long leg 19. Pivot tab 15 thus supports upper section 30 of support unit 13. The second point of support furnished by pivot tab 33 assures that bracket 11 remains assembled even when not installed on a railing.

Bracket 11 is assembled by simply inserting upper section 30 of support unit 13 into long leg 19 of clamp unit 15 through the space between support tab 33 and long leg 19 with tab 25 within slot 27 and captured between two pairs of points 31. Then, to install bracket 11 onto rail A, bracket 11 is tilted to place short leg 18 of clamp unit 15 under bottom corner C of rail A, and bend 34 of support unit 13 is pushed down along the side of rail A opposite from corner C.

As can be appreciated by viewing FIG. 1, when a shelf, plant, or any other item is supported upon lower section 32 of support unit 13, the torque exerted upon support unit 13 is counteracted by clamp unit 15 which is hooked under corner C of rail A. At the same time tab 25 acting against the points 31 prevents support unit 13 from separating from clamp unit 15 because of movement in the horizontal direction. The result is a strong support bracket installed on the rail without the need of any tools or additional parts.

Figure 2:
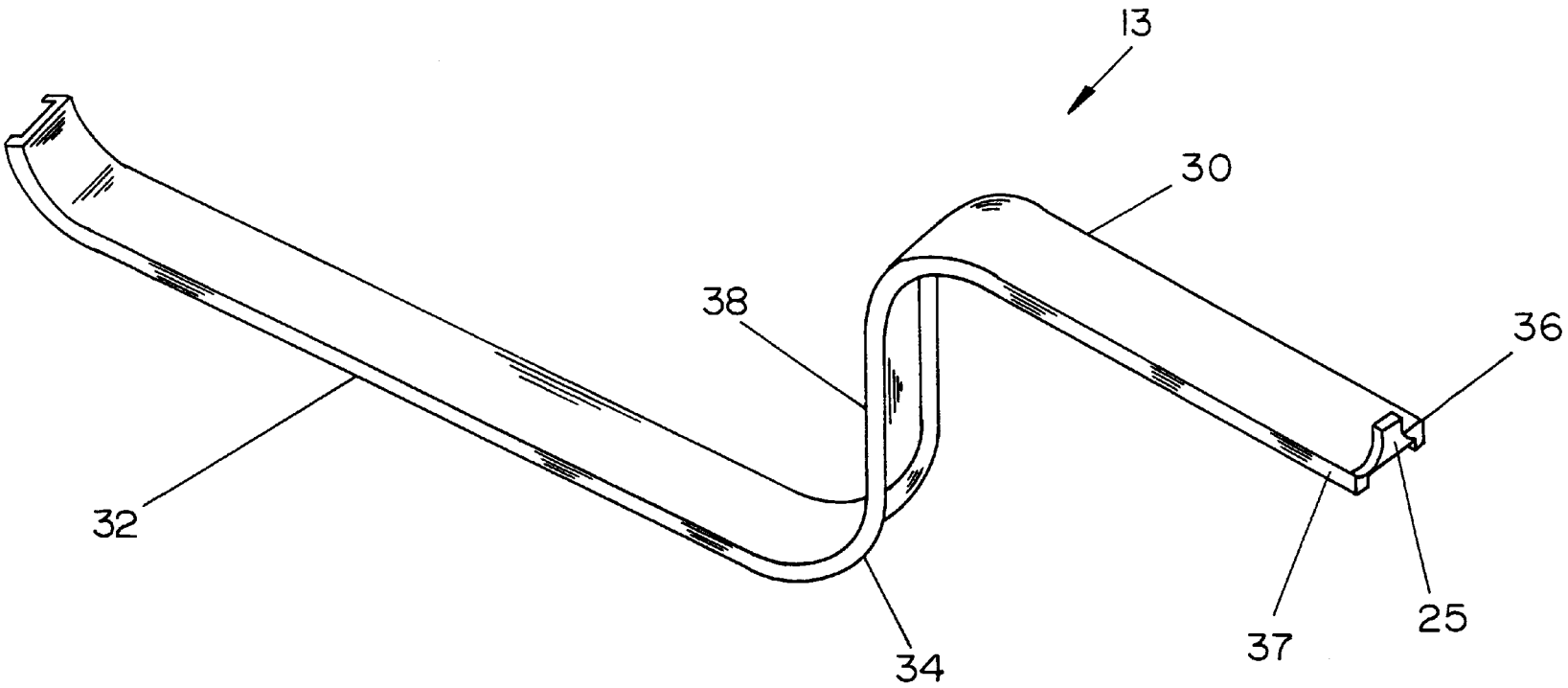
FIG. 2 is a perspective view of the preferred embodiment of the support unit of the invention.

FIG. 2 is a perspective view of support unit 13 of bracket 11 which more clearly shows its simple structure. Support unit 13 is constructed from a strap and is formed with two bends to form upper section 30 and lower section 32, which are in the same vertical plane, are offset from each other in parallel horizontal planes, and protrude in opposite directions from bridge section 38. FIG. 2 also shows more clearly, at end 36 of support unit 13, that the preferred embodiment of support unit 13 is constructed as a shallow channel to furnish greater strength without the need to use a much thicker strap material. Locking tab 25 is formed at the end 36 of support unit 13 by trimming off the sides 37 of the channel and bending part of the web of the channel upward.

Figure 3:
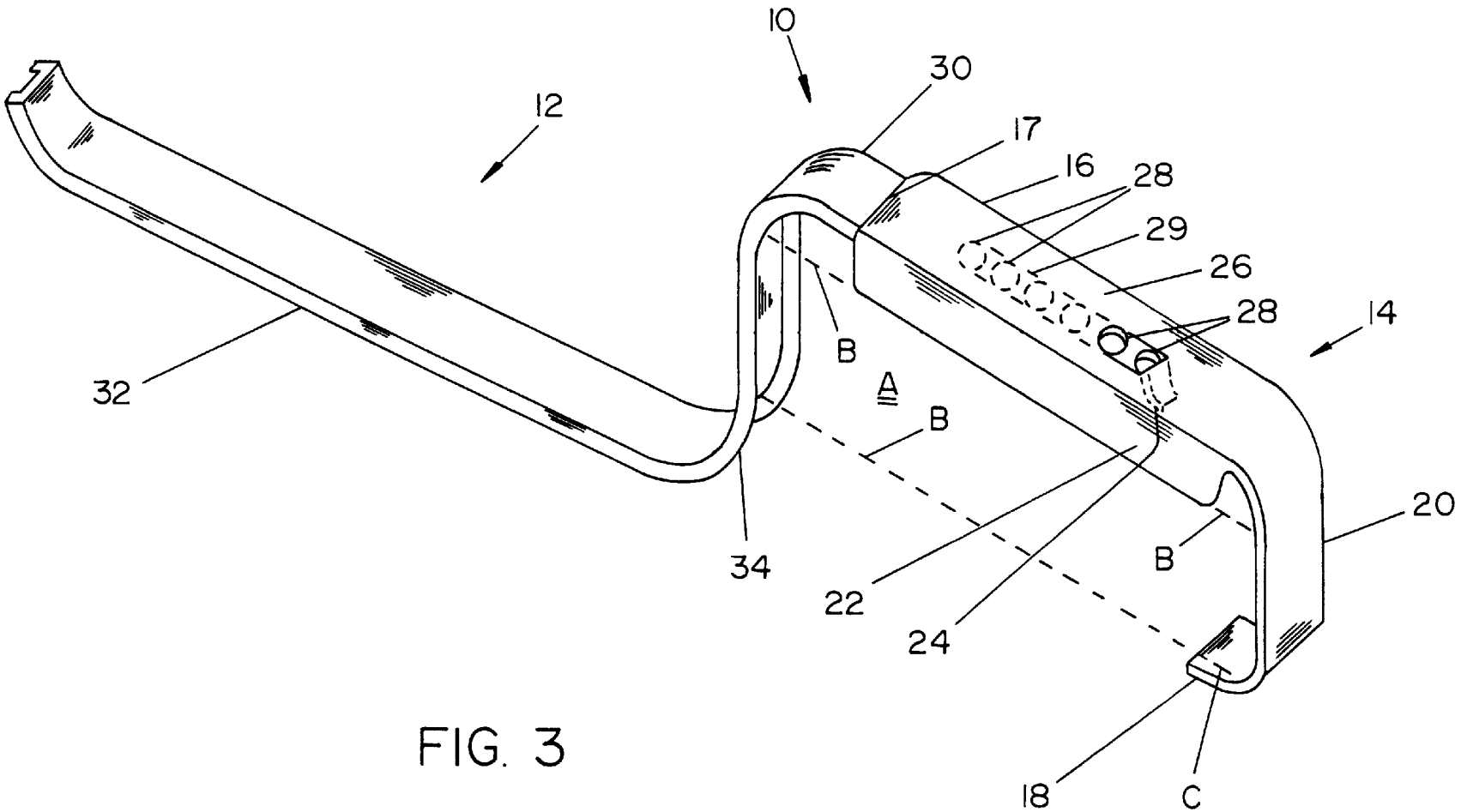
FIG. 3 is a perspective view of an alternate embodiment of the assembled bracket of the invention.

FIG. 3 is a perspective view of an alternate embodiment of assembled bracket 10 of the invention, in which support unit 12 and clamp unit 14 interlock around rail A which is located in the space whose boundaries are indicated by dashed lines B when bracket 10 is in use.

As with the preferred embodiment, clamp unit 14 is built in the shape of a hook with long leg 16, short leg 18, and connecting section 20. Short leg 18 and connecting section 20 are typically constructed as simple straps, but long leg 16 is a channel with sides 22 of significant height. Sides 22 are dimensioned so that they extend beyond the length of tab 24 which is cut from web 26 of long leg 16. Tab 24 is bent in the direction toward short leg 18 and extends through holes 28 or slot 29, which is shown by dashed lines, that are located in upper section 30 of support unit 12. Tab 24 is actually formed so that it angles below and under the end of the wall of one of the holes 28 through which it extends, thus locking support unit 12 to clamp unit 14 when the two are assembled and forced around the rail A. Tab 24 can actually be bent in either direction, toward connecting section 20 or away from it.

Bracket 10 is assembled by simply inserting upper section 30 of support unit 12 into long leg 16 of clamp unit 14 with tab 24 within a hole 28 and forced against the wall of hole 28 which is nearest to connecting section 20. Then, to install bracket 10 onto rail A, bracket 10 is tilted to place short leg 18 of clamp unit 14 under bottom corner C of rail A, and bend 34 of support unit 12 is pushed down along the side of rail A opposite from corner C.

Figure 4:
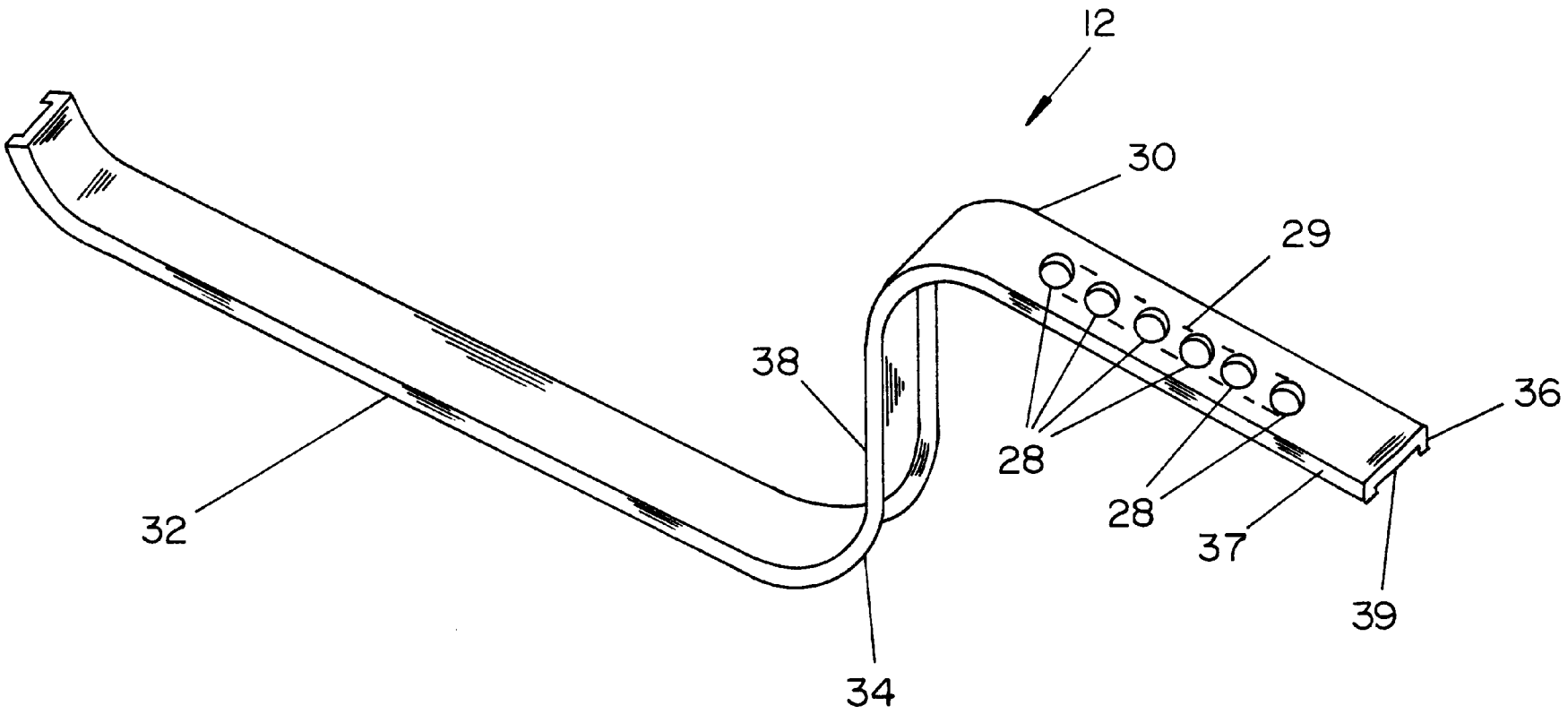
FIG. 4 is a perspective view of an alternate embodiment of the support unit of the invention.

FIG. 4 is a perspective view of support unit 12 of bracket 10 which more clearly shows its simple structure. Support unit 12 is constructed from a strap and is formed with two bends to form upper section 30 and lower section 32, which are in the same vertical plane, are offset from each other in parallel horizontal planes, and protrude in opposite directions from bridge section 38. Slot 29, which is shown in dashed lines more clearly than it is shown in FIG. 3, can be used as an alternative to holes 28 which were described above in regard to FIG. 3. However, holes 28, which are spaced along the same line as slot 28, furnish the advantage of permitting bracket 10 to be used on several different size railings with each hole determining a different spacing between bridge section 38 of support unit 12 and connecting section 20 of clamp unit 14. A slot similar to the one shown in FIG. 1, with points protruding from its sides, can also be used on upper section 30 of support unit 12 to provide an adjustable bracket. However, if only a single size railing is anticipated, straight sided slot 29 can replace multiple holes 28.

Figure 5:
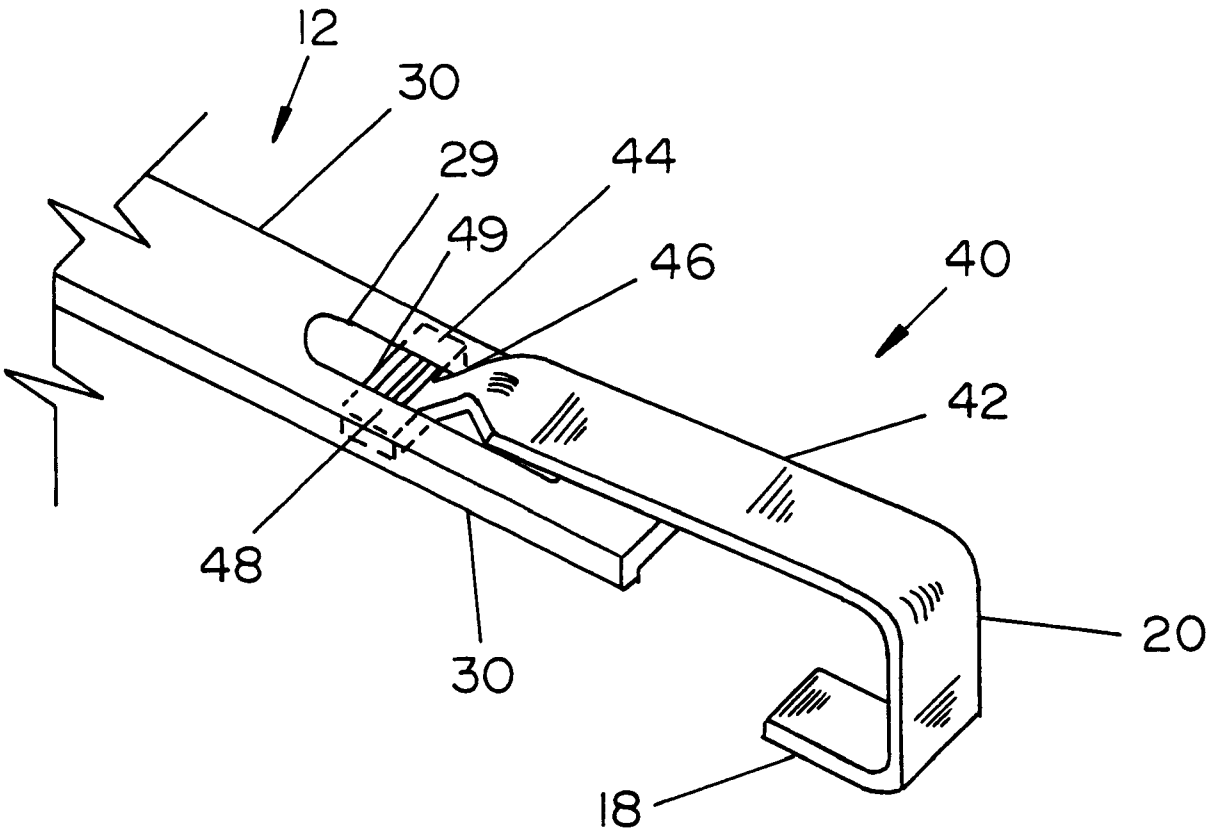
FIG. 5 is a perspective view of an alternate embodiment of the clamp unit of the invention.

FIG. 5 is a perspective view of an alternate embodiment of the clamp unit used in bracket 10 of the invention. Clamp unit. 40 of FIG. 5 has the same short leg 18 and connecting section 20 as clamp unit 14 of FIG. 3, but long leg 42 is constructed differently and it interlocks with support unit 12 in a different manner. Clamp unit 40 does, however, require that support unit 12 include slot 29 (FIGS. 3 and 4), or that holes 28 be enlarged sufficiently to permit tab 44 of clamp unit 40 (FIG. 5) to be inserted through holes 28.

Long leg 42 of clamp unit 40 is constructed of simple flat strap material so that it will be flat against upper section 30 of support unit 12 when installed. Long leg 42 also has tab 44 attached to its end remote from connecting section 20. Tab 44 is connected to long leg 42 by neck 46. As can be seen in FIG. 5, tab 44 is offset from long leg 42, and the offset distance is such that top 48 of tab 44 is spaced from the near surface of long leg 42 by the thickness of web 39 of upper section 30 of support unit 12 (FIG. 4). Thus, clamp unit 40 is installed onto support unit 12 by sliding tab 44 through slot 29 or enlarged holes 28, and then aligning long leg 42 parallel with upper section 30 of support unit 12. This places tab 44 and long leg 42 on opposite sides of upper section 30 and tab 44 between sides 37 of the channel of upper section 30. Therefore, long leg 42 and upper section 30 remain parallel, and they can not be separated.

It can easily be appreciated that when clamp leg 40 is used. with support unit 12 which has a slot 29, the two parts can easily be adjusted for the size of the rail on which bracket 10 is mounted by simply sliding the parts relative to each other. However, to make inadvertent sliding less likely when using slot 29, top surface 48 of tab 44 is constructed with serrations 49, and the underside of web 39 of upper section 30 of support unit 12 (FIG. 4) can be made with similar serrations, so that the serrations interact and prevent sliding unless the surfaces of the parts are purposely separated.

Figure 6:
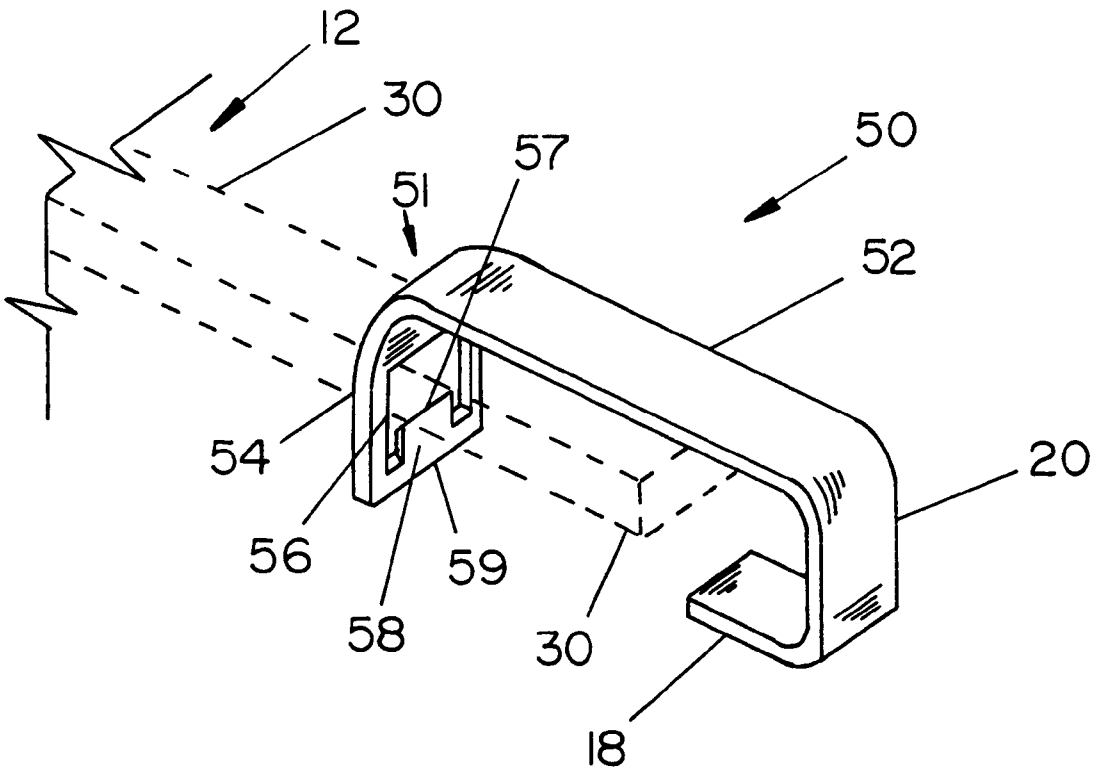
FIG. 6 is a perspective view of another alternate embodiment of the clamp unit of the invention.

FIG. 6 is a perspective view of another alternate embodiment of the clamp unit of the invention. Clamp unit 50 of FIG. 6 has the same short leg 18 and connecting section 20 as clamp unit 14 of FIG. 3, but long leg 52 is constructed differently and it interlocks with support unit 12 in a different manner. Clamp unit 50 does not require that support unit 12 include slot 29 or holes 28 (FIGS. 3 and 4).

Clamp unit 50 has simple end piece 54 attached to end 51 of long leg 52 which is remote from connecting section 20, and hole 56 is located within end piece 54. End piece 54 is oriented at an angle to long leg 52, and hole 56 is shaped and dimensioned so that the channel shaped cross section of upper section 30 of support unit 12 (FIG. 4) will slide through hole 56. Furthermore, hole 56 has scraper 58 protruding up from bottom edge 59 of hole 56, and scraper 58 can include sharpened edge 57 on its exposed top edge. Thus, when upper section 30, shown in phantom lines, is fitted through hole 56 and short leg 18 is hooked under the edge of a rail and support unit 12 is forced downward, scraper 58 bites into the underside of upper section 30 of support unit 12, and clamp unit 50 does not slide upon upper section 30. This locking action is aided even more when serrations are added to the underside of web 39 of upper section 30 (FIG. 4).

Figure 7:
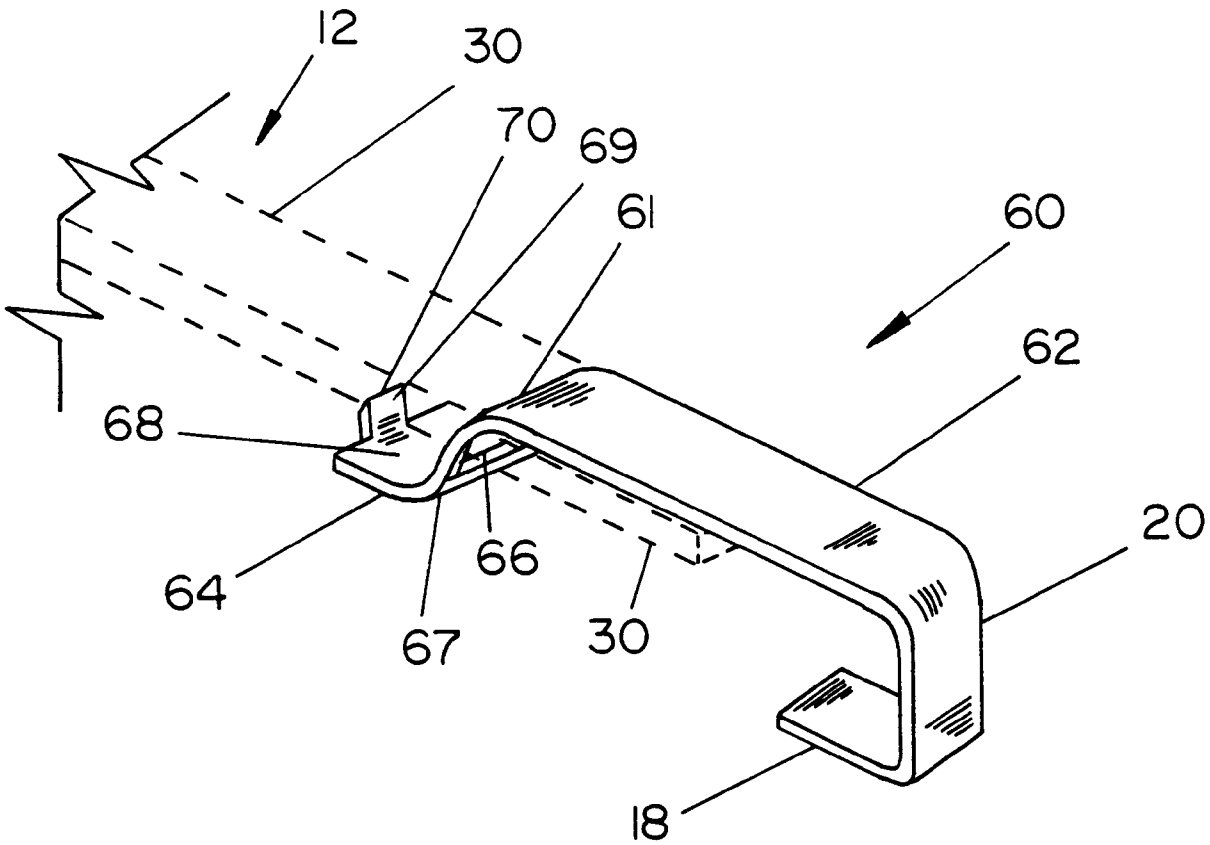
FIG. 7 is a perspective view of another alternate embodiment of the clamp unit of the invention.

FIG. 7 is a perspective view of another alternate embodiment of the clamp unit of the invention. Clamp unit 60 of FIG. 7 has the same short leg 18 and connecting section 20 as clamp unit 14 of FIG. 3, but long leg 62 is constructed differently and it interlocks with support unit 12 in a different manner. Clamp unit 60 also does not require that support unit 12 include slot 29 or holes 28 (FIGS. 3 and 4).

Clamp unit 60 has end piece 64 attached to end 61 of long leg 62 which is remote from connecting section 20, and hole 66 is located within end piece 64 in the angled portion 67 of end piece 64 which is oriented at an angle to long leg 62. Hole 66 is shaped as a rectangle and dimensioned so that upper section 30 of support unit 12 (FIG. 4) will slide through hole 66. End piece 64 also includes extension 68 which is oriented in a plane approximately parallel to the plane of long leg 62, but extension 68 is offset from long leg 62 by the total height of upper section 30. Therefore, when upper section 30 of support unit 12, shown in phantom lines is placed through hole 66, extension 68 is below web 39 of upper section 30. Scraper 69 is also attached to the end of extension 68 and is oriented so that it is protruding up from extension 68. Scraper 69 can include sharpened edge 70 on its exposed top edge. Thus, when upper section 30 is fitted through hole 66 and short leg 18 is hooked under the edge of a rail and support unit 12 is forced downward, scraper 69 bites into the underside of upper section 30 of support unit 12, and clamp unit 60 does not slide upon upper section 30. This locking action is aided even more when serrations are added to the underside of web 39 of upper section 30 (FIG. 4).

As can be appreciated from FIGS. 1, 3, 5, 6, and 7, the essential requirement of the connection between any clamp unit: and a support unit is that the parts interlock in a manner that furnish one lower contact point between them which is below upper section 30 of the support unit, and one upper contact point between them which is above upper section 30. In FIG. 1 the lower contact point is at pivot tab 33, and the upper contact point is in slot 27 at locking tab 25. In FIG. 3 the lower contact point is at finger 24, and the upper contact point is at end 17 of long leg 16 which is the end remote from connecting section 20. For the clamp units of FIGS. 5, 6, and 7, the upper contact point is end 36 (FIG. 4) of upper section 30 while the lower contact points are top surface 48 of tab 44, edge 57 of scraper 58, and edge 70 of scraper 69, respectively. This two point connection transfers the torque from support unit 12 to the clamp units where short leg 18 is hooked on rail corner C to counteract the torque.

The invention thereby furnishes a bracket for attachment to a deck rail, which uses only two parts, yet is strong, stable, and adjustable.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

What is claimed as new and for which Letters Patent of the United States are desired to be secured is:

1. A bracket for installation on a railing comprising:

a support unit comprising a strap formed with two bends to form an upper section and a lower section joined by a bridge section, with the upper section and the lower section in the same vertical plane, offset from each other in parallel horizontal planes, and protruding in opposite directions from the bridge section;

a clamp unit comprising a strap shaped as a hook with a short leg and a long leg, with the short leg and the long leg in the same vertical plane, offset from each other in parallel horizontal planes, and extending in the same direction from a connecting section to which they are both attached;

connecting means with a first part formed on the upper section of the support unit and a second part formed on the long leg of the clamp unit, with the connecting means interconnecting the support unit to the clamp unit so that the support unit and clamp unit are connected together to form a bracket;

wherein the second part of the connecting means is a slot formed in a surface of the long leg of the clamp unit with points protruding from the sides of the slot, the first part of the connecting means is a locking tab protruding from the upper section of the support unit and inserted into the slot in the long leg of the clamp section, and the points restrict the motion of the tab within the slot; and further including a pivot tab attached at the end of the long leg of the clamp unit remote from the connecting section and separated from the slotted surface of the long leg so that when the locking tab of the upper section of the support unit is inserted into the slot the upper section is captured between the pivot tab and the long leg.

* * * * *